US005826309A

United States Patent [19]

Tsamas

[11] Patent Number: 5,826,309

[45] Date of Patent: Oct. 27, 1998

[54] JEWELRY SAFETY CLASP

[76] Inventor: Anton Tsamas, 408 Kaplan Ave., Hackensack, N.J. 07601

[21] Appl. No.: 934,271

[22] Filed: Sep. 19, 1997

[51] Int. Cl.[6] ..... A44B 17/00; A44B 11/00

[52] U.S. Cl. ..... 24/68 J; 24/616; 24/265 WS; 24/71 J

[58] Field of Search ..... 24/68 J, 69 J, 24/70 J, 71 J, 68 E, 68 T, 265 WS, 265 EC, 265 BC, 598.4, 598.1, 589, 597, 616, 618, 662, 629, 326–334; 63/12, 20.4, 29.1, 3.1

[56] References Cited

U.S. PATENT DOCUMENTS

| | | | |
|---|---|---|---|
| 3,913,182 | 10/1975 | Fontana | 24/71 J |
| 4,024,607 | 5/1977 | Rosenberg et al. | 24/616 |
| 4,593,440 | 6/1986 | Tsamas | 24/265 WS |
| 4,675,955 | 6/1987 | Nakamura | 24/68 J X |
| 4,928,359 | 5/1990 | Gagnebin | 24/74 J |
| 5,191,685 | 3/1993 | Aoki et al. | 24/68 J X |
| 5,231,740 | 8/1993 | Mohebkhosrvavi | 24/616 |

*Primary Examiner*—Randolph A. Reese
*Assistant Examiner*—Robert J. Sandy
*Attorney, Agent, or Firm*—Stroock & Stroock & Lavan LLP

[57] ABSTRACT

A jewelry safety claps includes a hook member with a hook disposed thereon. A housing member includes a hole formed thereon for receiving the hook and to be selectively disengageable from the hook. At least one foot is disposed in the housing member and is capable of moving between a first position corresponding to retraction within the housing member and a second position corresponding to extending outside of the housing member. A foot receiving portion disposed on the hook member for receiving the foot and selectively retaining the foot therein prevents disengagement of the hook member from the housing member.

8 Claims, 3 Drawing Sheets

FIG.5
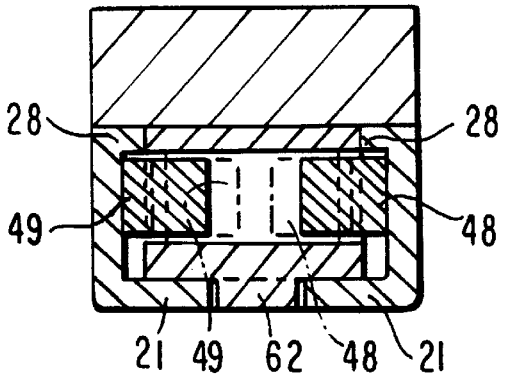
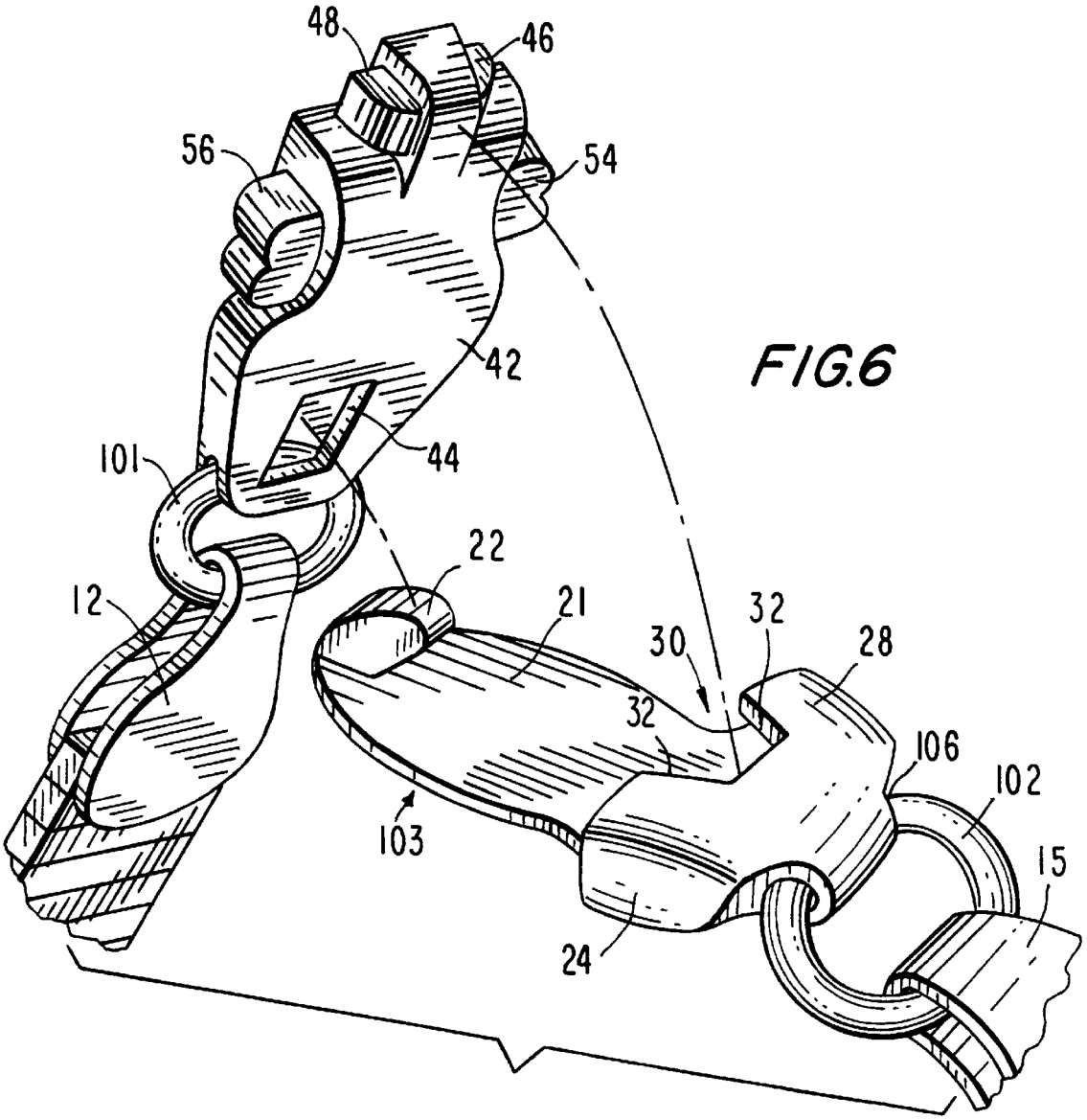
FIG.6

JEWELRY SAFETY CLASP

BACKGROUND OF THE INVENTION

The present invention is directed to a jewelry clasp, and in particular a clasp allowing one-handed operation for locking a bracelet or the like.

Jewelry such as bracelets and anklets having a clasp for affixing the jewelry in a circle around the body are well known in the art. The most common types of clasps are bayonet clasps and lobster clasps. Bayonet clasps include a female end affixed to one end of the open bracelet. The female end has a slot. The slot is adapted to receive the male end of the bayonet clasp which is attached to the other end of the open bracelet. The male member of the bayonet clasp includes a spring-biased member for being received in the slot of the female member. Because the male member is provided with anchoring portions, as the male member is fit within the slot, the spring action of the male member biases the anchoring portion to mate with the edges of the slot of the female member securing the male member within the female member. The anchoring portions interacting with the blocking portions prevent inadvertent release of the male member from the female member. The male member is released by pressing the male member against the spring action to provide clearance for the anchoring portion relative to the slot to allow the male member to be withdrawn from the female member.

Bayonet clasps have been satisfactory, however they suffer from the disadvantages that with the play in the clasp caused by the normal use of the clasp, the anchoring portions and the blocking portions begin to wear allowing easy and inadvertent removal from the female portion. To overcome this shortcoming, the bayonet clasp manufacturers usually provide an auxiliary hook to anchor one end of the jewelry band to the other. However, this suffers from a deficiency of requiring a supplemental locking mechanism, a more complex construction, a more complex operation for locking and unlocking, and increased costs because of the requirement of additional expensive jewelry material to form the hook.

Lobster clasps have a ring affixed to one end of the opened bracelet and a closed hook resembling a lobster claw affixed to the other end of the open bracelet for hooking onto the ring member. By articulating the "thumb" of the lobster claw shaped hook, the ring member may be attached and released from the ring member. Because of the play between the hook and the ring member held therein, as a result of the movement of the wearer, the hook and the ring wear thin because of the friction between the two. Additionally, because of the forces applied by the ring on the hook when made taut, the hook is subject to bending and may cause a clearance between the "thumb" of the lobster hook and the remainder of the lobster hook so that the ring member inadvertently falls out.

The further disadvantage of the lobster hook is that the thumb is spring biased. Gold, a common material used in jewelry because it maintains its properties at high temperatures, cannot be used as a spring material in a lobster clasp. Gold does not have sufficient resiliency to be used in a lobster clasp because of the need for the spring to move through a large range of motion to articulate the thumb. Therefore, a steel clasp is used. However, steel becomes unworkable at relatively low temperatures while gold maintains its properties at very high temperatures. Therefore a lobster clasp, using steel, can not be welded to the jewelry end, increasing the cost and complexity by requiring a ring for coupling the clasp to the jewelry end.

A further disadvantage of both types of commonly used clasps, is that because of the need to articulate a spring biased member and to fit one member into another in a direction parallel to the locking mechanism and the jewelry ends, securing the ends of the jewelry is substantially a two handed operation; requiring one hand to anchor the receiving member while utilizing the other hand to push the locking member into the receiving member. In the case of the bayonet clasp, it requires the one hand to hold the female member while the other hand pushes the spring loaded male member into the female member and secures the safety latch, while in the lobster hook, one hand is required to operate the spring to open the thumb while the second hand loops the ring member into the hook. Such operation often requires the assistance of a third party when the jewelry is a bracelet and it becomes difficult to use both hands.

Accordingly, a jewelry safety clasp for securing ends of jewelry, such as in a bracelet or anklet, which reduces the play and resulting wear and tear at the clasp and facilitates one hand operation is desired and provided by the instant invention.

SUMMARY OF THE INVENTION

Generally, in accordance with the invention, a first member includes a hook and receiving portion. A second member includes a housing. An opening is formed in said housing for receiving said hook. At least one foot is slidably disposed in the housing so as to slide between a first position in which the foot does not extend from the housing and a second position in which the foot extends from the housing. A spring disposed within the housing biases the foot to extend from housing, the receiving portion being adapted to receive and selectively interlock with the foot when in the extended second position.

Accordingly, it is an object of the instant invention to provide an improved jewelry safety clasp.

A further object of the invention is to provide a jewelry safety clasp which substantially eliminates the play in the clasp, reducing the wear and tear between the interlocking members.

Another object of the instant invention is to provide a jewelry clasp having a longer useful life.

Yet another object of the instant invention is to provide a jewelry clasp which may be formed of gold allowing it to be soldered to jewelry.

Still a further object of the invention is to provide a jewelry clasp which facilitates one handed operation.

Still other objects and advantages of the invention will in part be obvious and in part be apparent from the specification.

The invention accordingly comprises the features of construction, combination of elements, and arrangement of parts which will be exemplified by the constructions hereinafter set forth and the scope of the invention will be indicated in the claims.

BRIEF DESCRIPTION OF THE DRAWINGS

For a fuller understanding of the invention, references had to the following description taken in connection with the accompanying drawings, in which:

FIG. 5 a sectional view taken along line 5—5 of FIG. 4; and

FIG. 6 is a perspective view of a jewelry safety clasp constructed in accordance with a second embodiment of the invention shown in the unsecured position.

DETAILED DESCRIPTION OF THE PREFERRED EMBODIMENTS

Figure 1:
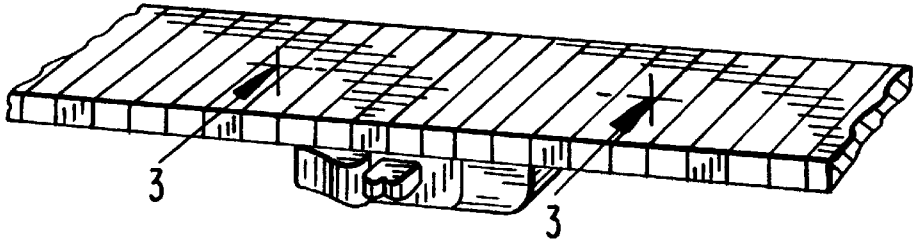
FIG. 1 is a perspective view of a jewelry safety clasp constructed in accordance with the invention in the interlocked position.
Figure 2:
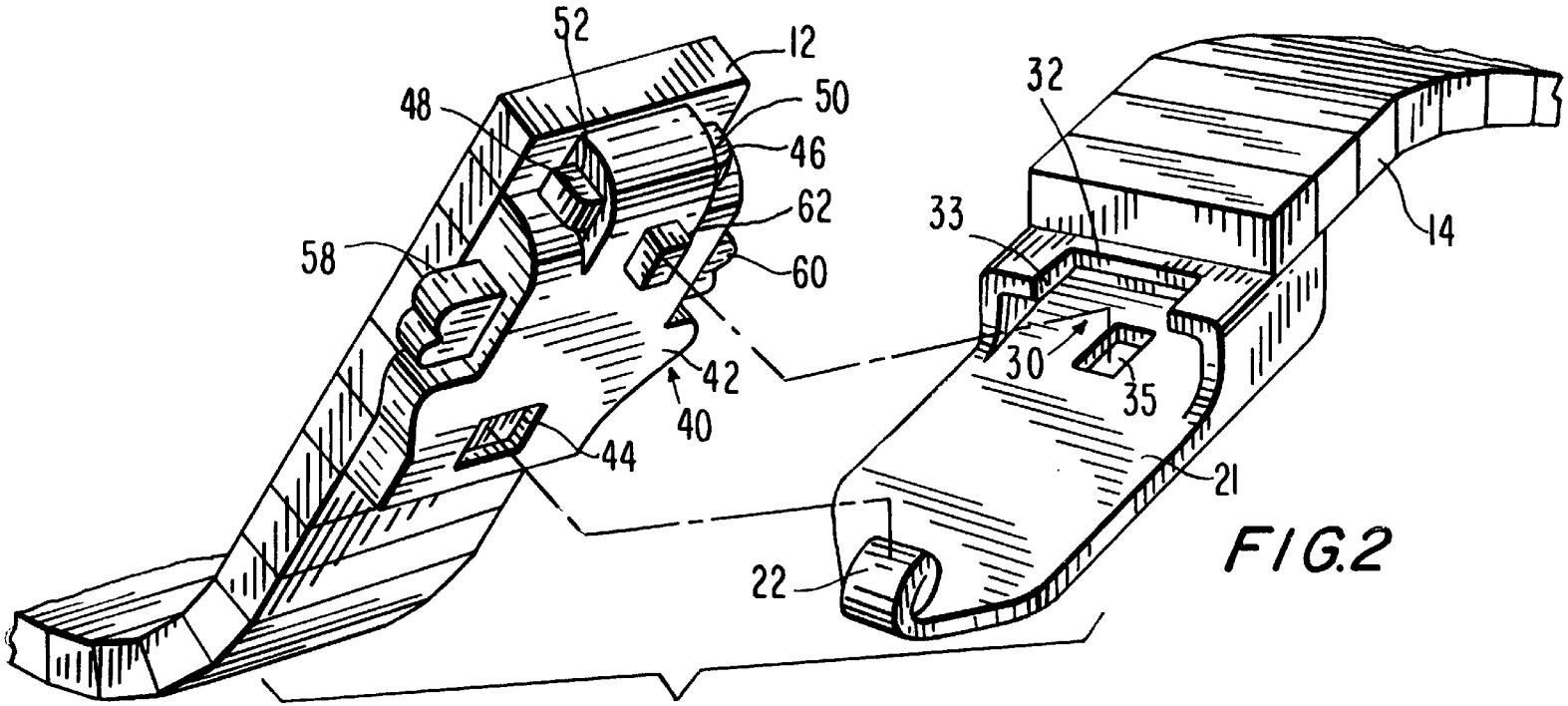
FIG. 2 a perspective view of a jewelry safety clasp constructed in accordance with the invention, showing the two members separated.

Reference is made to FIGS. 1–5 in which a jewelry safety clasp, generally indicated as 10, constructed in accordance with a first embodiment of the invention, is provided. Jewelry safety clasp 10 is disposed between ends 12, 14 of an opened circular jewelry piece such as an anklet, bracelet, necklace, wristwatch or the like. Ends 12, 14 are held together in a locked fashion closing the circle. Jewelry safety clasp 10 includes a hook member 20 and a housing member 40 which are selectively engageable to each other to hold ends 12, 14 together and release from each other as shown in FIG. 2, to allow separation of end 12 from end 14.

Hook member 20 is affixed to jewelry end 14 and includes a floor 21. A hook 22 is formed on floor 21. In a preferred embodiment hook 22 is rounded to allow pivoting within an opening as described below, but hook 22 need not be rounded for operation of the invention. A receiving portion 24 is formed on hook member 20 and includes sidewalls 26 extending from floor 21 and separated from each other across a gap. A top piece 28 extends between sidewalls 26 to form a receiving space 30 between floor 21, sidewalls 26 and top piece 28. A clearance opening 35 is formed within top 28. A hole 35 is formed in floor 20.

Housing member 40 is attached to the opposite end 12 of the jewelry. Housing member 40 includes a casing 42 and a hole 44 is formed in the top surface. A hook 62 is also provided extending from its top surface away from end 12. Casing 42 includes openings 50, 52 from which respective feet 46, 48 project. Feet 46, 48 are retractable within casing 42 and also may extend from casing 32 as shown in FIG. 2. In a preferred embodiment feet 46, 48 have cammed, slopped or angled surfaces. Openings 58, 60 are formed on opposed sides of casing 42 to allow buttons 54, 56 to extend there through. Actuation of buttons 54, 56 cause respective feet 46, 48 to retract within casing 42.

Figure 3:
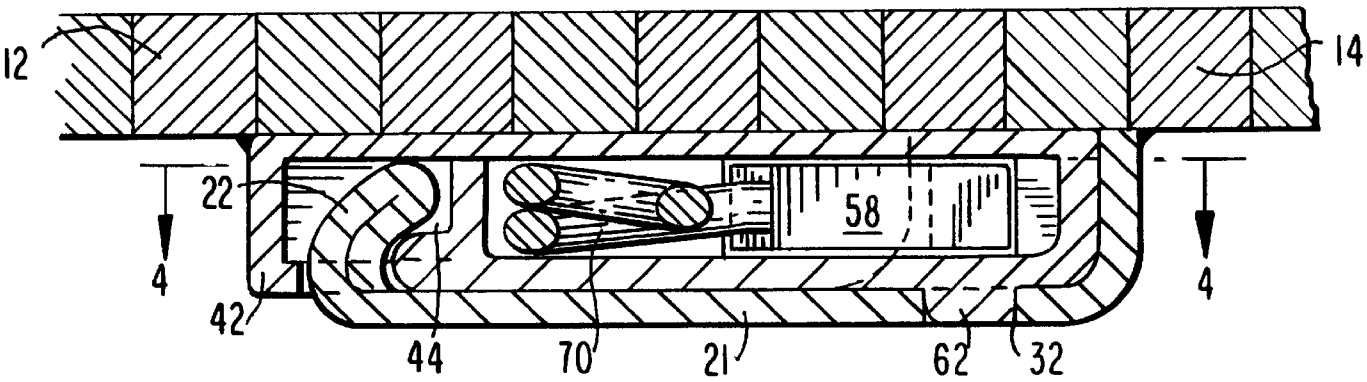
FIG. 3 a sectional view taken along lines 3—3 of FIG. 1.
Figure 4:
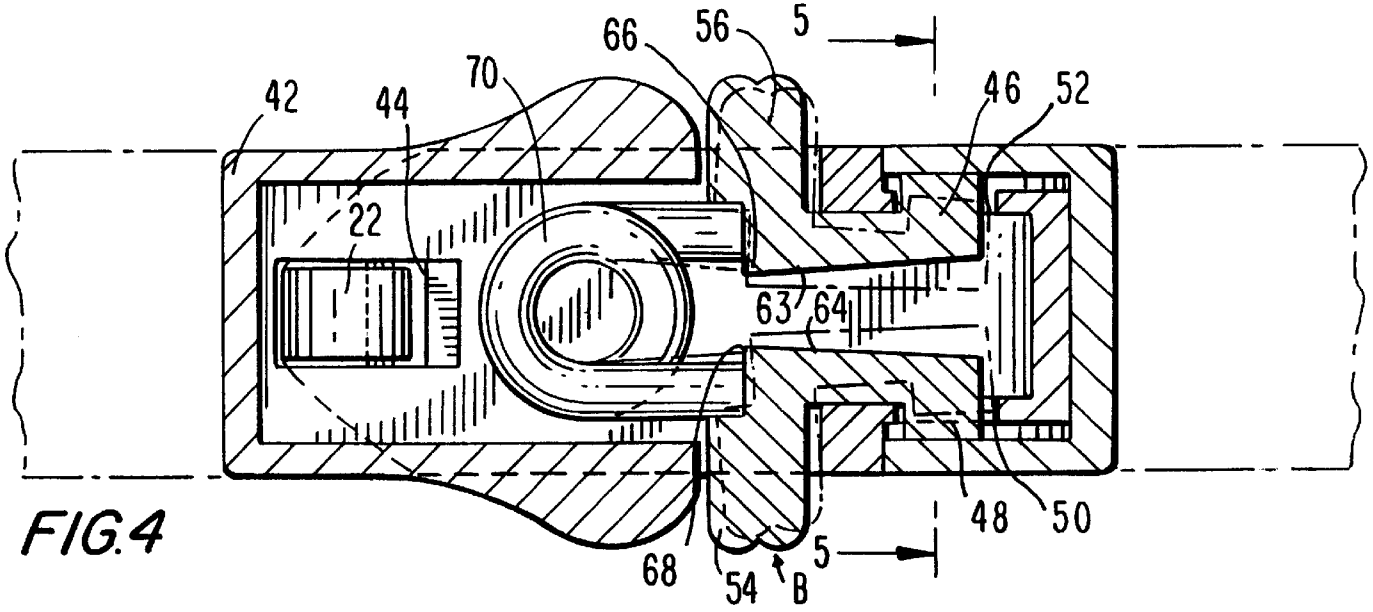
FIG. 4 a sectional view taken along line 4—4 of Fig.3.

Reference is now particularly made to FIGS. 3 and 4 in which the internal structure of housing member 40 is provided. Foot 46 is coupled to button 56 by leg 63. At the connection of leg 63 and button 56, a recess 68 is formed. A spring 70, disposed within casing 42 has a first arm 72 and second arm 74. Arm 72 is received within recess 68 so that spring 70 biases button 56 and foot 46 to extend from casing 42.

Similarly, foot 48 is coupled to button 54 by leg 64. A recess 66 is formed at the connection between leg 64 and button 54. Arm 74 is received within recess 66 so that arm 74 of spring 70 biases button 54 and foot 48 to extend out from casing 42. In a preferred embodiment, spring 70 is a coil spring and legs 63, 64 and spring 70 are formed as separate pieces, however it is contemplated that the structure including spring 70, feet 46, 48, buttons 54, 56, and legs 63, 64 can be formed as a unitary structure or as a hair pin spring or the like. Because biasing is done by the two arms the spring must only perform a small range of movement so that spring 70 may be made of gold.

In a preferred embodiment, each foot 46, 48 extends beyond casing 42 by about 0.5millimeters. Additionally, the separation distance between leg 63 and 64 is about one millimeter. When buttons 54, 56 are pressed in the direction of arrows A, B (FIG. 4), against the bias of spring arms 72, 74, feet 46, 48 move in the direction of arrows A, B, respectively, to be withdrawn into casing 42. If buttons 54, 56 were pushed until leg 63, 64 contact each other, then feet 46, 48 are completely withdrawn within housing 42. As will be seen below feet 46,48 only need be withdrawn sufficiently to clear edges 33.

The operation of jewelry safety clasp 10 will now be described with additional reference to FIG. 5. To affix open ended circular jewelry, by way of example a bracelet, end 12 is placed on the wrist of the user with hole 44 and hook 62 facing away from the wrist. Hook 22 is then inserted into hole 44 and pivoted downwards to bring floor 21 into contact with casing 42. As hook number 20 is pivoted, hook 62 enters hole 32 and inner edges 33 of opening 32 come into contact with the camming surfaces 47, 49 of feet 46, 48. As rotation continues, edges 33 push against surfaces 47, 49 pushing feet 46, 48 against the bias of spring 70 forcing feet 46, 48 to move within casing 42. Once hook 20 is rotated into position so that feet 46, 48 have cleared top piece 28, spring 70, through arms 72, 74 bias feet 46, 48 to extend out from casing 42.

Receiving space 30 is sized and adapted to receive feet 46, 48 therein. Particularly referring to FIG. 5, as rotation is completed, feet 46, 48 will pass edges 33 so that spring 70 biases feet 46, 48 to extend from casing 42 and into receiving space 30. Extended feet 46, 48 are captured between floor 21 and top piece 28 to prevent separation of housing member 40 and hook member 20. By providing at least a first hook 22, one hand operation is facilitated because once hook 22 is initially placed in hole 44, the clasp now anchors the closed circle about the wrist of the user. All that is required is to rotate hook 20 so that feet 46, 48 are received by the feet receiving space 30 locking the clasp in place. Furthermore, hooks 22 and 62 acting together prevent movement in both the longitudinal direction and vertical directing preventing wear and tear on feet 46, 48 giving longer life to the clasp. As a result a more stable fastening structure is provided.

To disengage jewelry safety clasp 10, buttons 56, 54 are pressed in the direction of arrows A, B (FIG. 4). This causes feet 46, 48 to be withdrawn within casing 42 so that feet 46, 48 can now clear edges 33 on top piece 28 as shown in phantom in FIG. 5. Hook 20 is then rotated away from casing 42 and hook 22 is removed from hole 44 disengaging the two members of jewel safety clasp 10.

The jewelry safety clasp 10 including spring 70 may be made of gold to allow soldering of housing 42 to end 14. However, where soldering is not to occur, then other spring materials, such as plastics or steel may be utilized. Furthermore, as is described below, the secondary hook 62 and receiving hole 35 are not necessary for the proper operation of the invention but provide additional lateral stability by additionally anchoring hook member 20 and housing member 40 at two locations.

However, as shown in FIG. 6 in which a second embodiment of the invention is shown, only a single hook need be used.

Reference is now specifically made to FIG. 6 in which jewelry safety clasp 10', illustrating the second embodiment of invention, is provided. The primary difference between jewelry safety clasp 10 and jewelry safety clasp 10' prime is the elimination of the hook on housing member 40, the hole on the hook member, and the manner in which hook member 20 and housing member 40 are fixed to the jewelry ends. Like structure is identified by like numbers.

The first end 14 of a jewelry band includes an opening 15 through which a ring 102 passes. A hook member 103 includes an opening 106 for receiving ring 102. Hook 101 includes a floor 21 and, a rounded hook 22 extending therefrom, a receiving portion 24 defined by walls 26, floor 21 and top piece 28 define receiving space 30 adapted to receive feet 46, 48 of a housing member 100.

Housing member 100 is affixed to an end 12 of jewelry loop by ring 110. Housing member 100 includes a casing 42 for receiving a portion of ring 110. Casing 42 includes hole 44 adapted to receive hook 22. Buttons 54, 56 extend from casing 42 as do feet 46, 48. The internal structure of housing member 100 is the same as that of housing member 40.

Again, during use hook 22 is positioned within hole 44 anchoring the bracelet in the circular position. Hook 103 is then rotated about the pivot point formed by hook 22 and hole 44 towards casing 42. The camming surfaces of feet 46, 48 act against the edges 32 of top piece 28 depressing feet 46, 48 into casing 42. As rotation continues, the feet 46, 48 clear top piece 28 and are biased back into an extended position to trap feet 46, 48 within receiving space 30. Again, to release the clasp, buttons 54, 56 are pressed towards each other causing feet 46, 48 to withdraw into the casing 42 allowing clearance of the feet 46, 48 past top piece 28.

The above two embodiments are by way of an example. The concept of the invention will also work with a single hook 22 and a single foot, button structure. Additionally, it is contemplated that for aesthetic purposes, that the width of floor 21 may be at least as great as the extended wing span of buttons 54, 56 to hide buttons 54, 56 when in the engaged position. This will provide an overall smooth aesthetic to the interlocked clasp.

By providing the jewelry safety clasp, which includes two members, a first hook member having a hook thereon and a second housing member having an opening for receiving the hook, it becomes possible to anchor two ends of a bracelet during the fastening operation to facilitate one-handed operation of the jewelry clasp. By providing cammed feet which cooperate with the edges of a feet receiving portion which are brought into cooperation with the cammed feet by rotation of the hook member, one-handed operation is further facilitated while providing a locking mechanism which provides support both in the longitudinal and horizontal directions. By providing a button release, one-handed disengagement operation is also provided. By providing a structure in which the spring only exhibits limited movement, the spring may be formed of gold if the housing is to be soldered to the jewelry end.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall there between.

What is claimed:

1. A jewelry safety clasp comprising: a hook member, a hook disposed on said hook member; a housing member, said housing member including a hole formed therein for receiving said hook and adapted to allow said hook member to pivot about said hook when said hook is received by said hole; at least one foot disposed in said housing member capable of movement between a first position corresponding to being retracted within the housing member and a second position corresponding to extending outside of the housing member; a foot receiving portion disposed on said hook member for receiving said foot and selectively retaining said foot therein to prevent disengagement of said hook member from said housing member when said foot is in the second position.

2. The jewelry safety clasp of claim 1, further comprising means coupled to said at least one foot for causing said at least one foot to move from said second position to said first position to allow disengagement of said at least one foot from said foot receiving portion.

3. The jewelry safety clasp of claim 1, wherein said at least one foot has a cam surface, and said foot receiving portion includes at least a top portion, said top portion including an edge, said edge acting with said cam surface to move said at least one foot from said second position to said first position as said hook member is rotated.

4. The jewelry watch clasp of claim 1, further comprising a second hook formed on said housing member, and a second hole formed within said hook, said second hole being adapted to receive said second hook therein when said hook is rotated toward said housing member.

5. The jewelry safety clasp of claim 1, wherein a biasing means is disposed to bias said foot to extend to said second position.

6. The jewelry safety clasp of claim 5, wherein said biasing means includes a spring, said spring includes at least a first arm for biasing said at least one foot to extend from said housing member.

7. The jewelry safety clasp of claim 5, wherein said spring is made of gold.

8. The jewelry safety clasp of claim 1, wherein said hook is rounded.

* * * * *